United States Patent [19]

Focke

[11] 3,982,375

[45] Sept. 28, 1976

[54] PROCESS AND A DEVICE FOR WRAPPING ARTICLES, MORE PARTICULARLY, GROUPS OF CIGARETTES

[75] Inventor: Heinz Focke, Verden, Aller, Germany

[73] Assignee: Focke & Pfuhl, Verden, Aller, Germany

[22] Filed: Feb. 19, 1975

[21] Appl. No.: 551,211

[30] Foreign Application Priority Data

Feb. 19, 1974 Germany ..... 2407767

[52] U.S. Cl. ..... 53/32; 53/228; 53/389

[51] Int. Cl.[2] ..... B65B 11/16; B65B 19/22

[58] Field of Search ..... 53/148, 137, 32, 228, 53/229, 230, 231, 389; 93/12 C

[56] References Cited

UNITED STATES PATENTS

| | | | |
|---|---|---|---|
| 3,113,903 | 12/1963 | Harris | 53/137 |
| 3,367,221 | 2/1968 | Schmermond | 53/389 X |
| 3,735,767 | 5/1973 | Kruse | 53/148 |
| 3,802,325 | 4/1974 | Bardenhagen | 93/12 C |

FOREIGN PATENTS OR APPLICATIONS

| | | | |
|---|---|---|---|
| 831,628 | 3/1960 | United Kingdom | 53/228 |
| 752,793 | 7/1956 | United Kingdom | 53/228 |

*Primary Examiner*—Travis S. McGehee
*Assistant Examiner*—John Sipos
*Attorney, Agent, or Firm*—Sughrue, Rothwell, Mion, Zinn and Macpeak

[57] ABSTRACT

A method and an apparatus are disclosed for wrapping a two-piece foil blank about a group of articles, such as cigarettes, as the group is moved along a given path. The two-pieces, a main blank and a flap blank, are both cut from a single web of wrapping material and transported along different paths to the group of articles. The flap blank is placed on the group of articles as it moves along its path, and as the group contacts the main blank which is placed across its path of travel, it causes the main blank to be wrapped around the group of articles such that it overlaps a portion of the flap blank.

17 Claims, 4 Drawing Figures

PROCESS AND A DEVICE FOR WRAPPING ARTICLES, MORE PARTICULARLY, GROUPS OF CIGARETTES

BACKGROUND OF THE INVENTION

1. Field of the Invention

The present invention relates to a process and a device for wrapping articles, more particularly, groups of cigarettes, in two, preferably overlapping, partial blanks, namely a main section and a shorter flap section.

2. Description of the Prior Art

The invention relates primarily to the wrapping of groups of cigarettes in two tin foil blanks. In specific cigarette packs, particularly so-called hard box packs, the block of cigarettes is wrapped in a tin foil blank with a removable flap. Wrapping this two part tin foil blank about the block of cigarettes in such a way that the main section and the flap section overlap produces certain difficulties in terms of packaging processes.

The known packaging devices for wrapping groups of cigarettes in a two part blank operate in such a way that the main section and the shorter flap section are cut one after the other from a common web. The two blank sections are then caused to partially overlap each other by means of a slight lateral movement of one end of the sections and through relative displacement of the sections. A structure is thus formed which consists of the main section and the already overlapping flap section. This two part blank is then folded about the block of cigarettes in a U-shaped manner by inserting it in an opening.

Complicated machinery is required to produce the two part blank structure with an overlap between the main section and the flap section and to transport the resulting structure to the block of cigarettes and, in practice, this does not always operate without breakdowns.

SUMMARY OF THE INVENTION

The object of the present invention is to develop a process and a device with which articles, more particularly, groups of cigarettes, can be wrapped in two part blanks without breakdowns using simpler mechanical means.

The process according to the invention for solving this problem is characterized in that the flap section is supplied to the articles to be packed separately from the main section and is placed on the articles.

Accordingly, the essential theory of the invention consists in supplying the main section and the flap section separately from each other such that each section of the blank structure is placed on the product, namely the block of cigarettes, in a separate operating step. A specific feature of the method according to the invention is that the flap section is applied to the article in a careful manner separately from the main section and that it is placed on the article in the direction of displacement of the same while being displaced at the same speed. In this way, the flap section can be transferred to the article without any problems.

The blank sections, namely the main section and the flap section are also cut one after the other from a common web. The flap section is then moved away from the plane of displacement of the web and the main section and is supplied to the article by separate delivery devices. The packaging operation is carried out in the following manner: the flap section is first applied in the rear region of the article to its upper side in the relative position corresponding to the finished state and the main section is then folded about the article such that an overlap is produced between the main section and the flap section.

The device for wrapping articles in two part blanks comprises a delivery device in the form of an endless conveyor belt by means of which the flap section which has been removed from the plane of displacement of the web and the main section is supplied to to the article. The conveyor belt holds the flap section which has been placed on the article, in the final relative position during the continued displacement of the article.

Other objects, features and advantages of the present invention will be made apparent in the following detailed description of a preferred embodiment thereof which is provided with reference to the accompanying drawings.

DESCRIPTION OF THE PREFERRED EMBODIMENT

Figure 1:
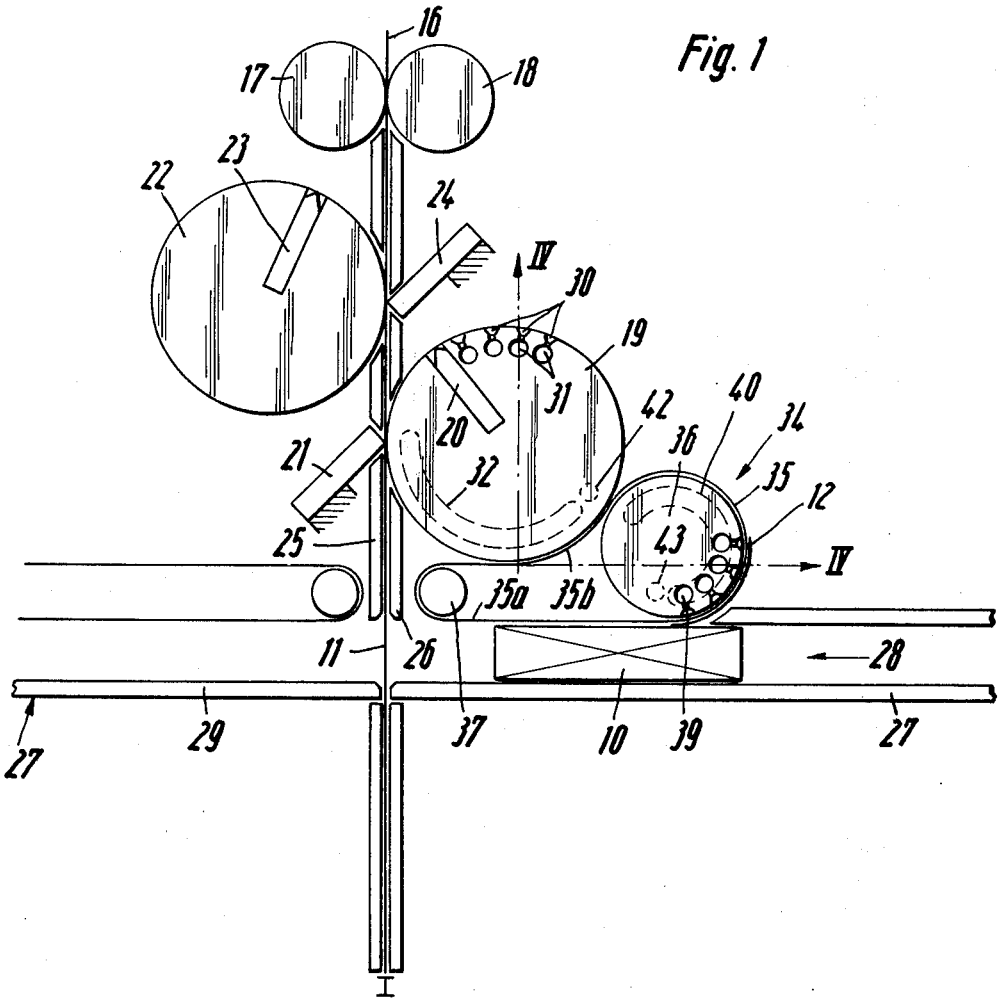
FIG. 1 is a diagrammatic side view of a device according to the invention.
Figure 2:
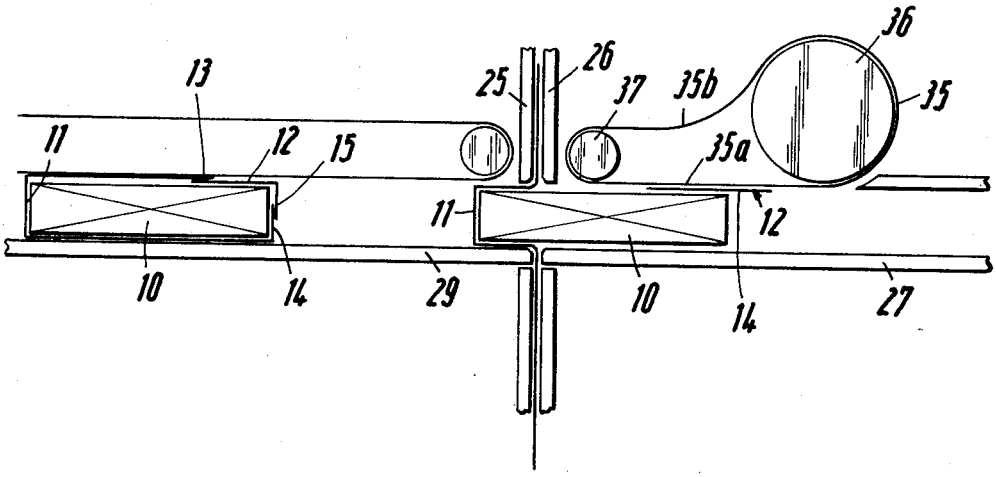
FIG. 2 shows a part of the device shown in FIG. 1 with a pack in a different position.

The embodiment of a part of a packing machine represented in the drawings is designed for wrapping articles 10, more particularly, groups or blocks of cigarettes in a two part wrapping. In this case, the two part wrapping consists of a main section 11 covering the major part of the article and a flap section 12. The main section 11 and the flap section 12 are wrapped about the article 10 with an overlap 13 such that on the front face of the article 10, which is disposed at the rear in the direction of displacement of the same, the edge parts 14 and 15 of the main section 11 and the flap section 12 are partially folded one above the other. When cigarettes are being packed, the afore-mentioned blank sections consists of tin foil.

The blank sections are cut from a web 16. This is drawn continuously from a bobbin (not shown) by a pair of pulling rollers 17 and 18 and supplied to a separating or cutting device.

The cutting device for separating the individual blank sections may be constructed in various ways to ensure that a (longer) main section 11 and a (shorter) flap section 12 are cut one after the other from a web 16. In the embodiment represented, two groups of blades are disposed in succession in the direction of displacement of the web 16. A first cutting blade 20 is disposed on a main roller 19. The blade 20 rotates continuously with the main roller 19. The cutting edge of the cutting blade 20 cooperates with the cutting edge of a stationary counterblade 21. The blades 20 and 21 are used to cut the rear ends, in the direction of displacement, of the main sections 11 from the adjacent part of the web 16.

A cutting blade 23 which rotates on a roller 22 and cooperates with a stationary counterblade 24 is connected in front of the blades 20 and 21. The blades 23 and 24 cut the rear end of the flap section 12 from the web 16. The circumferential speeds of the blades and the distances between them are selected in such a way that blank sections of the desired constant length are always produced.

After the cutting process, the main section 11 is moved fowards between suitable known guides 25 and 26 in the plane of the oncoming web 16 into the region of a conveyor 27 for the articles 10 being supplied, spaced apart from each other, in the direction of the arrow 28. The upper and lower limits of the conveyor 27 are interrupted in the region where the main section 11 is supplied at right angles thereto to allow this main section 11 to pass through the conveyor 27. The lower end of the guide 25 forms in a known manner with the upper edge of the lower wall 29 of the conveyor 27 an insertion opening for the article 10. In the region of this insertion opening, the main section 11 which is disposed at right angles to the conveyor 27 is folded in a U-shaped manner about the article 10 while it is being displaced.

On the other hand, the flap section 12 is supplied separately to the article 10 at a different point. For this purpose, the main roller 19 is provided with an adhesive region for the flap section 12. In the embodiment represented, this adhesive region comprises suction holes 30 which start from coaxially directed suction channels 31 and which open on the surface of the main roller 19. The open ends of these suction channels 31 are connected in a manner known per se to an annular channel 32 which is formed on the front side of the main roller 19 in a rigid annular piece 33. In FIG. 1 the annular channel 32 is represented by the perforated lines to show in clear and simplified form the region defined by this annular channel. The flap section 12 which is cut off by the blades 23 and 24 is gripped by the above-mentioned adhesive region of the main roller 19 and held fast against its surface by underpressure.

In this way, the main roller 19 moves the flap section 12 out of the plane of the web 16 to a separate delivery device 34. In the embodiment represented this consists of an endless conveyor belt 35 and a delivery roller 36. The conveyor passes over a part of the delivery roller 36 and over a deflecting roller 37 which is spaced apart from the roller 36 and has a smaller diameter. A lower part **35*a* of the conveyor 35 forms an upper limit of the conveyor 27. The upper part 35*b* passes over part of the periphery of the main roller 19. The conveyor belt 35 is disposed in an annular central recess 38 of the delivery roller 36 such that the upper surface of the narrower conveyor 35 is generally flush with the remaining surface of the delivery roller 36.**

For the purpose of receiving and gripping the flap section 12, the delivery roller 36 is also provided with a plurality of suction holes 39 distributed over the entire periphery of the roller 36 and opening outside of the region of the conveyor belt 35. The suction holes 39 are acted on by suction air via suction channels 40 and an annular channel 41 in the manner described in reference to the main roller 19.

Figure 3:
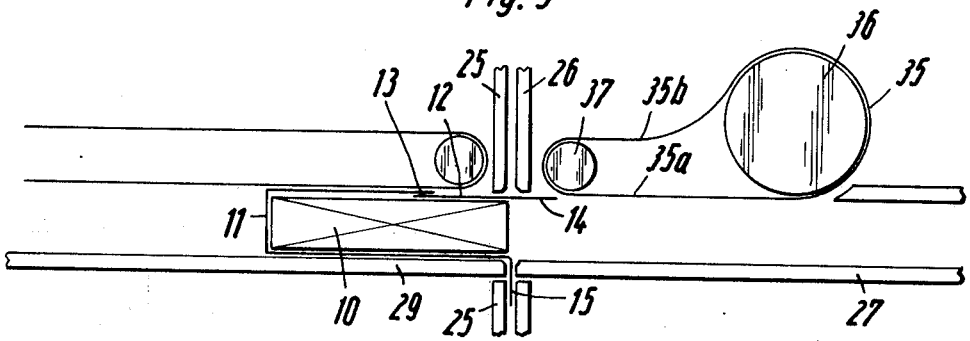
FIG. 3 represents the view shown in FIG. 2 at a different stage of the packaging process.
Figure 4:
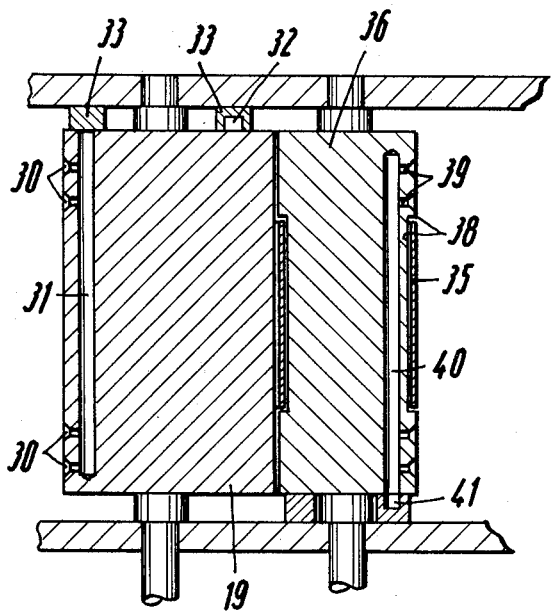
FIG. 4 is a sectional view along the line IV—IV through parts of the device shown in FIG. 1.

The flap section 12 is released from the main roller 19 in the region of an air venting channel 42 and is taken over by the delivery roller 36. This conveys the flap section 12 to the conveyor 27. The movements are coordinated in such a way that the flap section 12 is applied to the upper side of the article 10 in a specific relative position (FIG. 3). The flap section 12 is released by the delivery roller 36 in the region of an air venting channel 43. During the continued course of movement, the flap section 12 is held by the lower part **35*a* of the conveyor belt 35 against the article 10 which is being displaced at a corresponding rate, such that the edge flap 14 projects over the rear side of the article 10.**

In the region of the opening formed by the guide 25 and the lower wall 29 of the conveyor 27, the main section 11 is thereafter folded in a U-shaped manner about the article 10 and unsymmetrically with respect to the article, such that on the upper side the overlap 13 with the flap section 12 is produced and, on the lower side, a rear projecting part in the form of the edge flap 14 is produced. The edge flaps 14 and 15 and the lateral projecting edges, which are not represented, are folded against the article in a conventional, known manner.

It is obvious that the cutting device can be constructed in different ways. For example, it is possible to mount two cutting blades on the main roller, these blades cooperating with a stationary counterblade or a rotating counterblade.

I claim:

1. A process for wrapping a main blank and a flap blank about a group of objects, such as cigarettes, such that said blanks overlap wherein said group of objects travels along a first path comprising the steps of:

a. feeding a single web of wrapping material from a supply source;
b. cutting a main blank from said web of material;
c. cutting a flap blank from said web of material;
d. feeding said flap blank in a second path to place it on the group of objects;
e. feeding the main blank in a third path which intersects the first path of travel of the group of objects; and
f. folding said main blank around said group of objects such that a portion overlaps said flap blank.

2. The process of claim 1 comprising the further step of holding the flap blank on said group of objects while said group moves toward said main blank.

3. The process of claim 1 wherein the flap blank is placed on said group of articles adjacent the rearmost edge, measured in the direction of travel, and the main blank is wrapped around the forwardmost end.

4. The process of claim 1 wherein the third path is transverse to the first path of travel of said group of objects.

5. The process of claim 1 wherein the third path of travel of the main blank is coplanar with the path in which the single web of wrapping material is fed.

6. Apparatus for wrapping a main blank and a flap blank about a group of objects, such as cigarettes, such that said blanks are disposed in overlapping relationship, wherein said group of objects travels along a first path, comprising:

a. means to feed a single web of wrapping material from a supply source to the apparatus;
b. separating means to separate a main blank and a flap blank from said single web of wrapping material;
c. means to transport said flap blank along a second path and place it on said group of objects;
d. means to transport said main blank along a third path such that said main blank is placed in a position which intersects the first path of travel of said group of objects; and
e. means to fold said main blank over said group of articles such that a portion overlaps said flap blank.

7. The apparatus of claim 6 wherein said means to transport said flap blank along said second path also holds said flap blank on said group of articles as said group travels along its path.

8. The apparatus of claim 7 wherein said means to transport said flap blank along said second path comprises:

a. an endless belt movable in a closed path, a first portion of said belt contacting said separating means and a second portion of said belt defining an upper limitation of the path of travel of said group of articles; and b. means to attach said flap blank to said endless belt at said first portion and to detach said flap blank from said endless belt at said second portion such that said flap blank is placed on said group of articles.

9. The apparatus of claim 8 wherein the second portion of the endless belt is parallel to the path of travel of the group of articles and said parallel portion holds the flap blank on said group of articles as it moves along said path.

10. The apparatus of claim 9 wherein the separating means comprises:

a. a main roller having a generally cylindrical shape and being rotatable about its longitudinal axis, said main roller oriented such that its periphery contacts the single web of wrapping material, b. at least one cutting blade located on the periphery of the main roller such that said blade cuts the web of wrapping material upon coming into contact therewith; and c. holding means to hold the flap blank on said main roller after said flap blank comes into contact therewith.

11. The apparatus of claim 10 wherein the main roller has a plurality of bores therethrough, one end of the bores opening onto the periphery thereof, and the holding means comprises a source of vacuum connected to the other end of the bores so as to create a low pressure within the bores to thereby hold said flap blank on said main roller.

12. The apparatus of claim 11 further comprising a conveying roller over which the endless belt passes, said conveying roller rotating about an axis parallel to the longitudinal axis of the main roller and being located adjacent thereto, and holding means on said conveying roller to retain the flap flank on the endless belt as it passes around said conveying roller.

13. The apparatus of claim 12 wherein the conveying roller has a plurality of bores therein, one end of said bores opening onto the periphery thereof and wherein the holding means comprises a vacuum source connected to the other ends of said bores so as to create a low pressure within the bores to thereby hold the flap blank on the endless belt.

14. The apparatus of claim 13 wherein the conveying roller has a depression about the periphery in which is placed the endless belt, the depth of the depression being such that the outer surface of said belt is flush with the periphery of the conveyor roller.

15. The apparatus of claim 14 wherein the separating means further comprises:

a. a second roller having a generally cylindrical shape and being rotatable about its longitudinal axis, said second roller oriented such that its periphery contacts the single web of wrapping material; and b. a second cutting blade located on the periphery of the second roller such that said blade cuts the web of wrapping material upon coming into contact therewith.

16. The apparatus of claim 15 wherein the second roller is disposed on the side of the web of wrapping material opposite from that of the main roller.

17. The apparatus of claim 16 wherein the distance between the axes of the main and second rollers measured in a direction parallel to the plane of travel of the web of wrapping material is less than the diameter of either roller.

* * * * *